United States Patent [19]

Choi

[11] Patent Number: 4,865,367

[45] Date of Patent: Sep. 12, 1989

[54] SAFETY DOOR WITH COUNTERWEIGHT LOCKING

[75] Inventor: Mansam Choi, Monrovia, Calif.

[73] Assignee: Adams Rite Manufacturing Company, City of Industry, Calif.

[21] Appl. No.: 191,400

[22] Filed: May 9, 1988

[51] Int. Cl.[4] ..... F05B 65/10; F05B 15/20

[52] U.S. Cl. ..... 292/92; 292/153; 292/DIG. 66; 49/1; 49/7

[58] Field of Search ..... 292/21, 92, 153, DIG. 66; 70/92, DIG. 10; 16/48.5; 49/1, 7; 220/201; 160/1, 4, 9; 109/33; 126/287.5

[56] References Cited

U.S. PATENT DOCUMENTS

| | | | |
|---|---|---|---|
| 2,772,905 | 12/1956 | Dusing | 292/DIG. 66 |
| 3,659,885 | 5/1972 | Nail . | |
| 3,705,739 | 12/1972 | Adler | 292/DIG. 66 |
| 3,811,717 | 5/1974 | Floyd et al. | 292/DIG. 66 |
| 4,003,593 | 1/1977 | Wilzig et al. | 292/DIG. 66 |
| 4,003,614 | 1/1977 | Geer et al. . | |
| 4,007,954 | 2/1977 | Erickson | 292/DIG. 66 |
| 4,012,066 | 3/1977 | Savatore | 292/DIG. 66 |
| 4,130,306 | 12/1978 | Brkic . | |
| 4,145,900 | 3/1979 | Ohno | 292/DIG. 66 |
| 4,183,565 | 1/1980 | Allemann | 292/DIG. 66 |
| 4,311,329 | 1/1982 | Kral | 292/DIG. 66 |
| 4,458,928 | 7/1984 | Hirschbein . | |
| 4,510,779 | 4/1985 | Ahad . | |
| 4,726,613 | 2/1988 | Foshee | 292/DIG. 66 |

FOREIGN PATENT DOCUMENTS

| | | | |
|---|---|---|---|
| 2441396 | 7/1980 | France | 160/1 |
| 2447439 | 9/1980 | France | 292/DIG. 66 |

*Primary Examiner*—Gary L. Smith
*Assistant Examiner*—Eric K. Nicholson
*Attorney, Agent, or Firm*—William W. Haefliger

[57] ABSTRACT

A door lock structure includes a frame and a latch bolt carried by the frame for movement between retracted and advanced positions relative to a jamb. The bolt in its retracted position allows the door to open and when its in its advanced position blocks the closed door from opening. A first heat-fusible spring carried by the frame urges the bolt toward the advanced position. A lever pivotally carried by the bolt pivots between a first bolt blocking position and a second bolt freeing position. The lever has a second heat fusible spring carried by the bolt and acting on the lever for urging the lever toward the first bolt blocking position. The frame carries an actuator for pivoting the lever into the second position allowing movement of the bolt toward the retracted position. The lever also has a counterweight on the lever for keeping the lever in the first position to block retraction of the bolt in the event that the first and second springs melt.

12 Claims, 4 Drawing Sheets

FIG. 2.
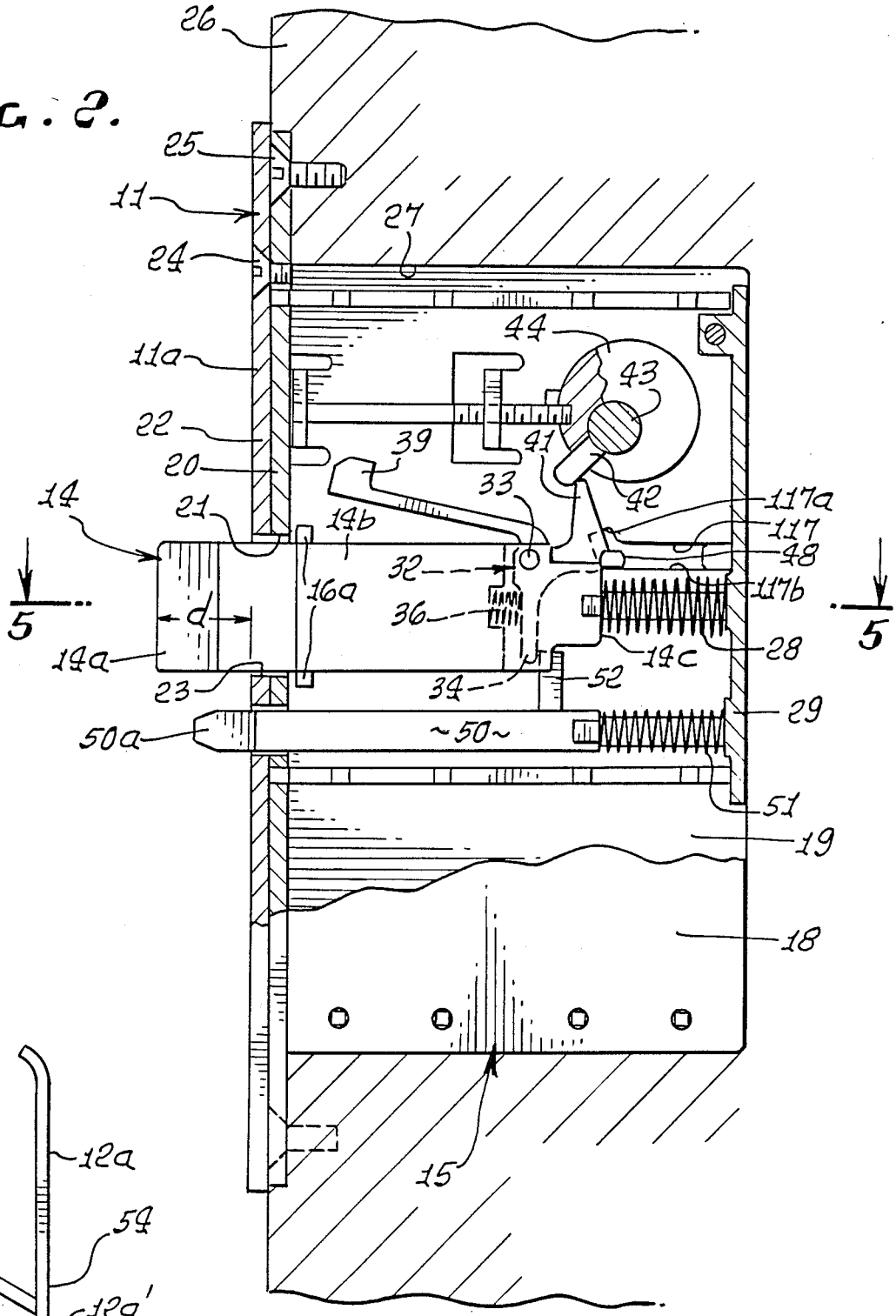
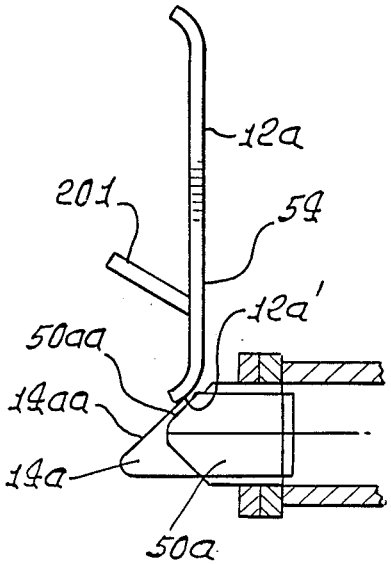
FIG. 2a.

SAFETY DOOR WITH COUNTERWEIGHT LOCKING

BACKGROUND OF THE INVENTION

This invention relates generally to fire doors, and more particularly to a panic bar-controlled door which is made non-openable in response to occurrence of high temperature that heats the door, as during a fire.

Panic bars normally are operable, when pushed, to quickly unlock doors During building-fire conditions, it is sometimes desirable to render the door non-openable, so as to prevent spread of the fire through door openings There is need for apparatus as disclosed herein, and which serves this purpose in a very simple, reliable, and highly efficient manner.

SUMMARY OF THE INVENTION

It is a major object of the invention to provide a door retention assembly meeting the above need. Basically, the assembly is operable to lock a door in closed position in response to high-temperature conditions, as during a fire, and the assembly typically includes a door element having an edge portion closable into adjacent relation to an edge portion of a jamb element, there being a strike carried by the jamb element. In this environment, the invention combines:

(a) a latch carried by the other element to relatively move into latching relation with the strike when the door element is closed relative to the header element, thereby to hold the door closed, (b) and control means to control movement of the latch into and out of said latching relation with the strike, said means including mechanism carried by the latch for movement between a first position in which said mechanism blocks the latch against movement out of said latching relation with the strike, and a second position in which said latch movement is unblocked, and a counterweight and spring both normally urging said mechanism into said first position when the latch is in latching relation with the strike.

Typically, the mechanism comprises a lever in the form of a traveling multi-arm bell crank pivotally carried by the latch. Also, the control means advantageously may include a rotor engageable with said mechanism, and rotatable in one rotary direction to cause said mechanism to move the latch out of latching relation with the strike.

It is another object of the invention to provide door lock structure including a frame, the structure including:

(a) a latch bolt carried by the frame for movement between retracted and advanced positions relative to a jamb, the bolt in retracted position allowing door-opening, and in advanced position blocking door-opening, (b) a first spring carried by the frame for urging the bolt toward advanced position, (c) a lever such as a bell crank pivotally carried by the bolt for pivoting between a first position in which the lever blocks bolt retraction, and a second position in which the bolt is free for retraction, (d) the lever having a first part, or arm, and there being a second spring carried by the bolt and acting on said first part for yieldably urging the lever toward said first position, (e) the lever having a second part, or arm, and there being an actuator carried by the frame and acting on said second part for pivoting the lever into said second position allowing movement of the bolt toward said retracted position, (f) and a counterweight on the lever for keeping the lever in said first position when the bolt is in said advanced position, as in the event of melting of said first and second springs.

In this regard, the door lock structure typically includes a blocking shoulder on said locking structure, and a dogging shoulder on the ever movable into position adjacent said blocking shoulder to block lever pivoting toward said second position in response to:

(i) bolt movement into said advanced position, and (ii) pivoting of the lever into said first position when the bolt is moved into said advanced position. A slot in the frame allows reception and travel of said dogging shoulder therealong, the blocking shoulder located adjacent the slot at one end of dogging shoulder travel therealong; and the slot typically extends in the direction of bolt movement between advanced and retracted position, with the slot having an offset adjacent said locking shoulder, and into which the dogging shoulder is pivotable in response to lever urging by the second spring. The counterweight tends to keep the dogging shoulder in said offset when the springs are melted, or otherwise deactivated.

These and other objects and advantages of the invention, as well as the details of an illustrative embodiment, will be more fully understood from the following specification and drawings, in which:

DRAWING DESCRIPTION

FIG. 2 is an enlarged vertical section taken through a portion of the door of FIG. 1, showing a latch bolt control means;

Figure 3A:
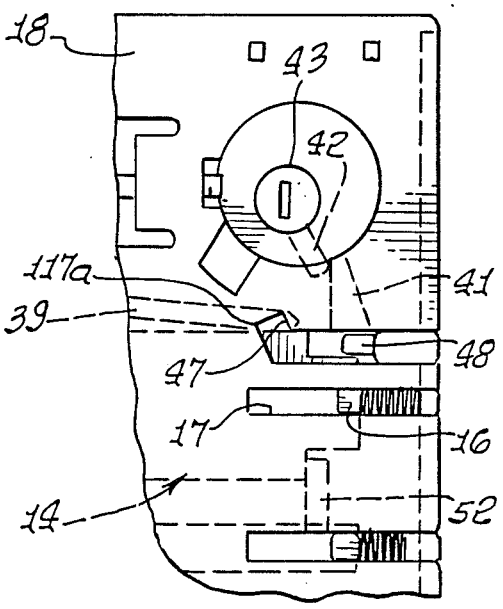
Figure 3:
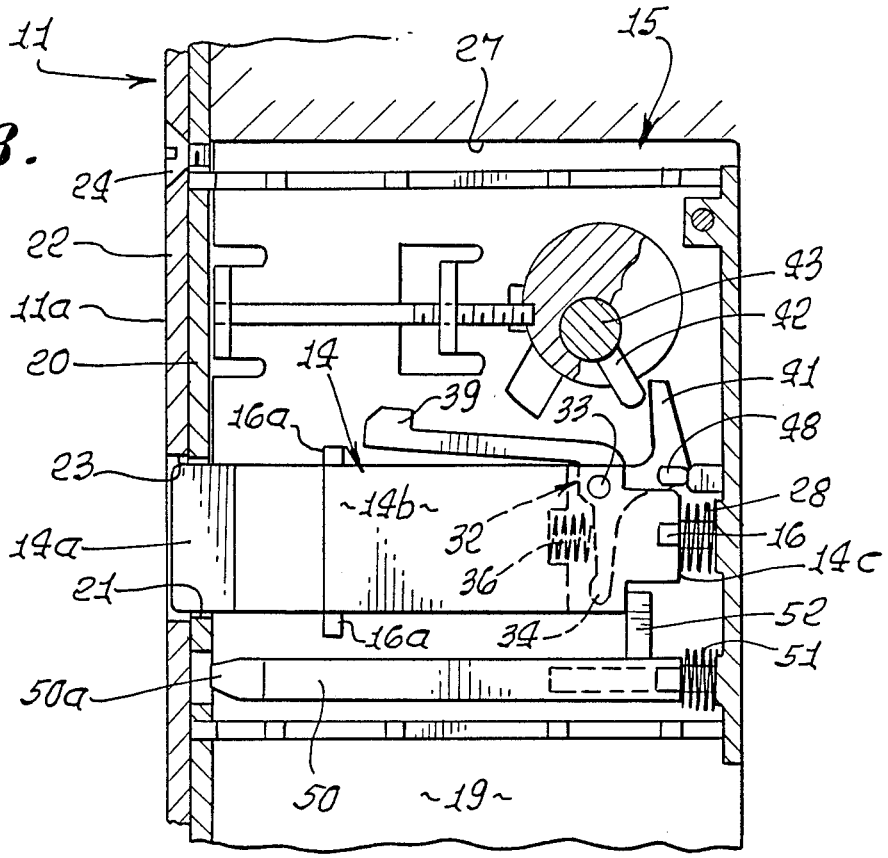
Figure 4:
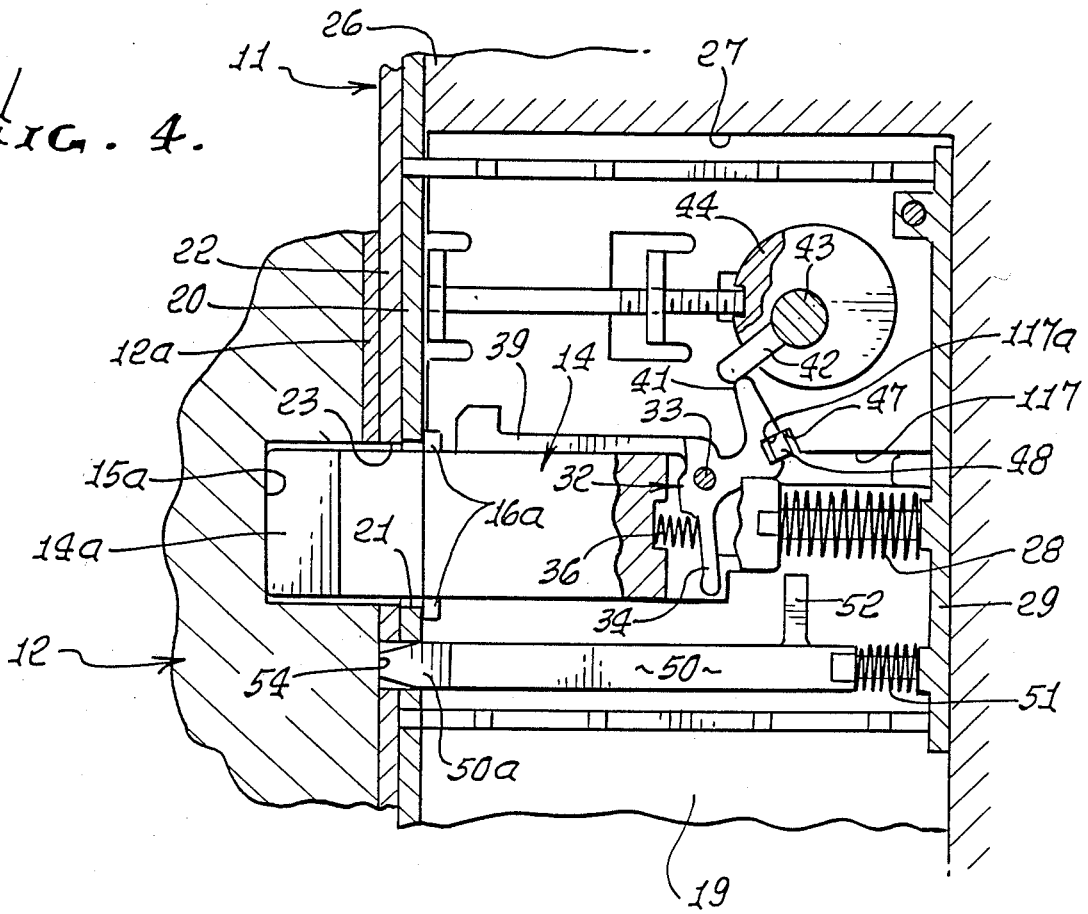
Figure 5:
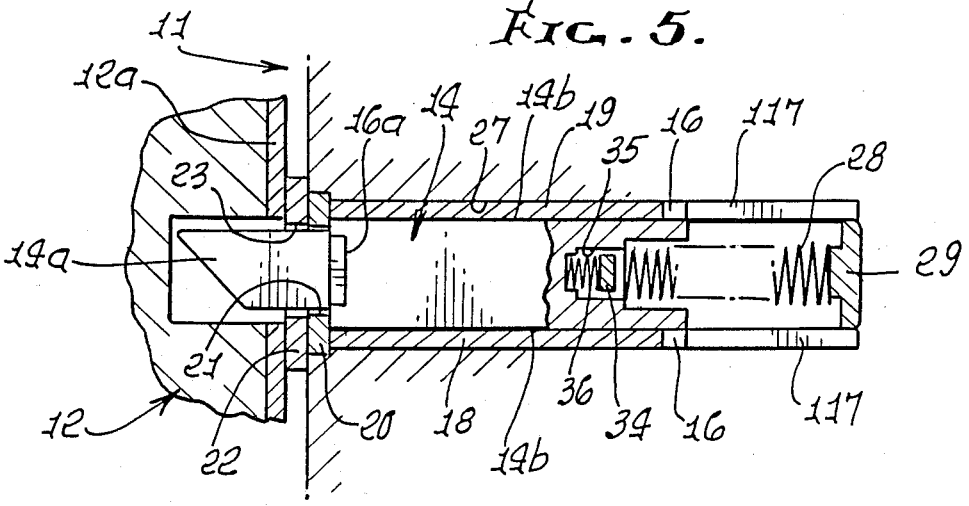

FIG. 2*a* is a fragmentary plan view showing bolt and actuator engagement with a strike;

FIG. 3 is a view like FIG. 2, showing the latch in retracted, i.e., unlatched state, in response to opening of the door;

FIG. 3*a* is another view like FIG. 3, with a front plate shown;

FIG. 4 is a view like FIG. 3, with parts in latching position, but after fusion of springs;

FIG. 5 is a plan view on lines 5—5 of FIG. 2; and

Figure 6:
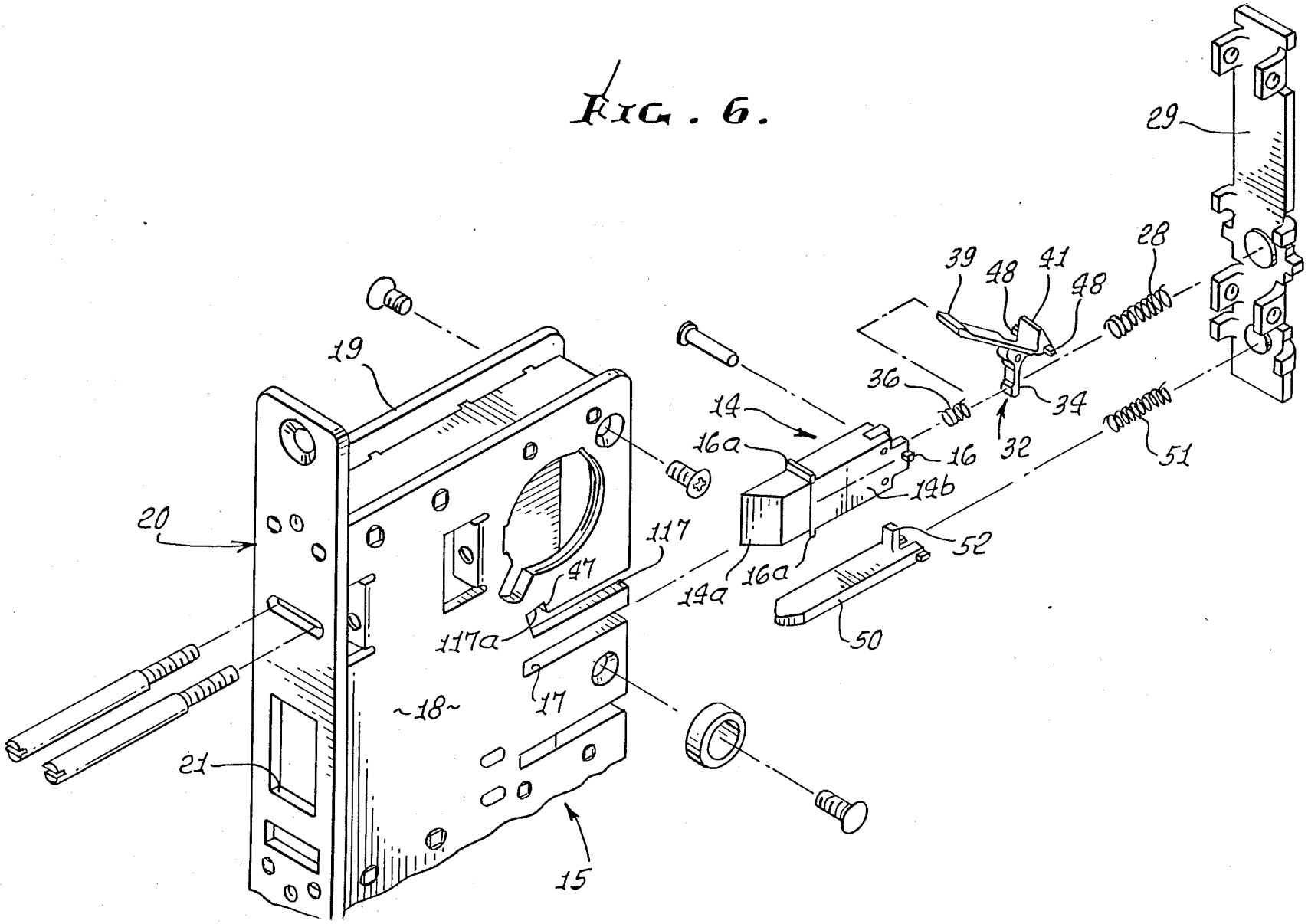

FIG. 6 is an exploded perspective view of the door-lock structure.

DETAILED DESCRIPTION

The door retention assembly seen at 10 in the drawings serves to lock a door element, as at 11, in closed position relative to a fixed frame element 12 carrying strike 12*a*. These elements typically may extend vertically, as seen in FIG. 4.

A door edge portion at 11*a*, and the strike 12*a* are relatively closable into adjacent relation, as in response to door-closing, as seen in FIG. 4, for example. The structures 12 and 12*a* may define a jamb.

In accordance with the invention, a latch is carried by the other element, i.e., the door element for example, so as to relatively move into latching relation with the strike when the door element is closed relative to the jamb element, and thereby hold the door closed. Also, in accordance with the invention, means including a counterweight and spring means are provided to control movement of the latch into and out of said latching relation with the strike.

In the example, a latch bolt 14 is carried by a frame 15 for movement between retracted (FIG. 3) and advanced (FIG. 4) positions relative to the jamb, the bolt 14 in retracted position allowing door-opening, and in advanced position blocking door-opening. Note the end portion 14*a* of the bolt received leftwardly into recess 15*a* in FIG. 4. The bolt is guided during its sliding movement by guide projections 16 projecting at opposite sides 14*b* of the bolt, and slidable in slots 17 in the side plates 18 and 19 of the frame. Plate 20 also defines a guide opening 21 for the bolt, and a faceplate 22 also defines a corresponding guide opening 23. Faceplate 22 is attached to frame mounting plate 20 as by fasteners 24; and fasteners 25 connect plate 20 to door structure 26. Frame 15 is received in a recess 27 in the door structure.

A first compression spring 28 is carried by the frame for urging the latch bolt 14 leftwardly, i.e., toward advanced position seen in FIGS. 2 and 4. As shown, the coil spring is confined between frame rear plate 29 and the right end 14*c* of the bolt.

Further, the control means includes mechanism carried by the latch for movement between a first position in which the mechanism blocks the latch against movement out of said latching relation with the strike, and a second position in which latch movement is unblocked, a counterweight and a spring, both normally urging said mechanism into said first position when the latch is in latching relation with the strike. One form of such mechanism comprises a traveling lever 32 or bell crank pivotally carried at 33 by the latch bolt for pivoting between a first position (FIG. 4) in which the lever blocks latch bolt retraction; and a second position (see FIG. 2) in which the latch bolt is free for retraction, with the bolt, to the right, i.e., to FIG. 3 (unlatched) position.

The lever has a first part such as downwardly projecting arm 34 located within a slot 35 in the bolt; and a second spring 36 is carried by the bolt to act on the arm or part 34, for yieldably urging or biasing the lever counterclockwise about the axis of pivot 33, and to FIG. 2 position. A counterweight 39 is provided on or integral with the lever to assist in keeping it in said first position, with the bolt in advanced (FIG. 4) position, as in the event of disruption or melting, i.e., fusing of the springs 28 and 36, during a fire. This keeps the lever in position to be blocked against rightward movement with the bolt, thereby to keep the door "deadlocked" or latched, unless it is forcibly unlatched as by manual pushing of a panic bar 40 seen in FIG. 1. The projecting counterweight seats on the top of the bolt to limit counterclocwise rotation of the lever.

In this regard, the lever has a second part such as upwardly projecting arm 41, and an actuator carried by the frame is rotatable by the push bar to act on the arm 41 for pivoting the lever into its second position, allowing movement of the bolt toward its FIG. 3 retracted position. See for example the actuator in the form of a pusher 42 carried by and rotatable by the rotor 43. The latter is carried by the bearing 44 associated with the frame 15. FIG. 3 shows the pusher 42 rotated counterclockwise to urge the arm 41 to the right, to retract the lock bolt. The rotor is rotated counterclockwise by panic bar mechanism, as that bar is pushed toward the door by the user; and when the bar is released, spring 28 returns bolt 14 to FIG. 4 (or FIG. 2) position. During pushing of the arm 41 to the left, in FIG. 2, the counterweight seats on top of the bolt to limit counterclockwise rotation of the lever. Thus, the counterweight has multiple functions.

Figure 1:
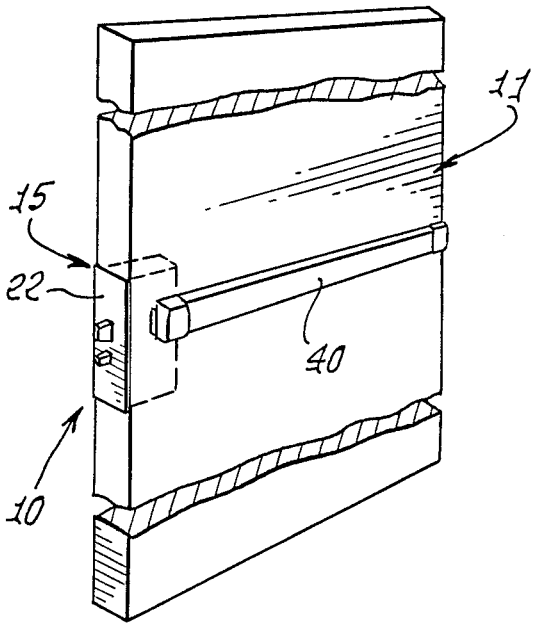
FIG. 1 is a perspective view showing a door, and door-opening means including a push or panic bar.

Also provided is a blocking shoulder or shoulders 47 on the frame plates 18 and 19, extending angularly forwardly and upwardly, as seen in FIGS. 2 and 6. For this purpose, elongated slot 117 in the frame has upwardly and forwardly extending portions 117*a* adjacent shoulders 47, for reception of dogs 48 on the lever (i.e., in the form of ears) and engageable with blocking shoulders 47, as in FIG. 4, to block retraction of the lever and latch. The dogs enter the slot 117 forward portions 117*a*, as the lever arrives proximate and into latching position; and prior to that time, the dogs travel in the slots 117, as for example is seen in FIG. 1. The projecting counterweight seats on the top of the bolt to limit counterclockwise rotation of the lever.

In this regard, the lever has a second part such as upwardly projecting arm 41, and an actuator carried by the frame is rotatable by the push bar to act on the arm 41 for pivoting the lever into its second position, allowing movement of the bolt toward its FIG. 3 retracted position. See for example the actuator in the form of a pusher 42 carried by and rotatable by the rotor 43. The latter is carried by the bearing 44 associated with the frame 15. FIG. 3 shows the pusher 42 rotated counterclockwise to urge the arm 41 to the right, to retract the lock bolt. The rotor is rotated counterclockwise by panic bar mechanism, as that bar is pushed toward the door by the user; and when the bar is released, spring 28 returns bolt 14 to FIG. 4 (or FIG. 2) position. During pushing of the arm 41 to the left, in FIG. 2, the counterweight seats on top of the bolt to limit counterclockwise rotation of the lever. Thus, the counterweight has multiple functions.

Also provided is a blocking shoulder or shoulders 47 on the frame plates 18 and 19, extending angularly forwardly and upwardly, as seen in FIGS. 2 and 6. For this purpose, elongated slot 117 in the frame has upwardly and forwardly extending portions 117*a* adjacent shoulders 47, for reception of dogs 48 on the lever (i.e. in the form of ears) and engageable with blocking shoulders 47, as in FIG. 4, to block retraction of the lever and latch. The dogs enter the slot 117 forward portions 117*a*, as the lever arrives proximate and into latching position; and prior to that time, with the help of spring 36 and counterweight 39 (it does not enter there automatically) the dogs travel in the slots 117, as for example is seen in FIGS. 3 and 3*a*. The dogs are released from the slot forward portions as the pusher 42 rotates the lever clockwose during initial pushing of the lever and latch toward unlatching positions.

An actuator 50 travels in relation to the bolt 14 to allow movement of the lever dogs 48 into deadlocking position. It is continuously urged leftwardly by relatively strong spring 51, causing an upward projection 52 on the actuator 50 to leftwardly engage the lever arm in FIG. 2, holding dogs 48 down and free of slot offsets 117*a*.

Referring to FIGS. 2 and 2*a*, as the door approaches the fixed position strike 12*a* (i.e., approaches closed position), the positions of the bolt 14, actuator 50, and lever 32 are as shown. Actuator 50 is urged to the left by relatively stronger spring 51, so that its projection 52 urges the lever 32 clockwise about pivot 33, with dog 48 pressed down on lower edges 117*b* of slot 117 just below the slot offset 117*a*. This aligns the dog 48 with slot 117, so that when bolt end portion 14a engages the strike 12a, the bolt can be displaced to the right, and is moved rightwardly a distance "d", as shown, in response to camming engagement with the strike.

This carries the lever 32 (on the bolt) to the right, and the actuator 50 also is simultaneously displaced to the right due to camming engagement of its end 50a with the strike angled surface 12a' immediately following initial engagement of the bolt end 14a with the strike angled surface 12a'. See FIG. 2a in this regard, and the equally angled camming surfaces 14aa and 50aa of the bolt and actuator ends. The bolt end 14a subsequently returns leftwardly into latching position in the strike latching recess 15a as the bolt completes its closing leftward movement under the influence of compression spring 28; however, the actuator 50 then remains in rightwardly displaced position due to engagement of the leftward tip of its end 50a with strike surface 54. Accordingly, the lever 32 is then rotated counterclockwise by spring 36, and dog 48 enters slot offset 117a, thereby preventing rightward movement of the bolt i.e., it is now "deadlocked" in door-closed "latched" position. See FIG. 4.

Accordingly, the lever 32 may be seen to be responsive to closing of the door, as via displacement of the actuator 50 (by engagement with the strike) to relieve the lever, allowing the lever to rotate clockwise, aligning dogs 48 with slot 117, so that the lever can subsequently rotate counterclockwise for deadlocking of the bolt when the bolt end is displaced into latching position, with the door closed. If the spring 36 should become disabled (or melts as during a fire), the counterweight 39 exerts torque about pivot 33, dropping down to urge the dogs 48 into slot offset 117a, as described, for deadlocking the bolt, in door-closed position. See FIG. 4.

Upper and lower flanges 16a integral with the bolt 14 also have a safety function in that they block access to the lever of unlatching tools. The latter, for example, might be employed by a burglar, and pushed through openings at 23 and 21 in an attempt to left the counterweight from FIG. 4 position, rotating the lever clockwise to release the dogs 48 from the dogging shoulders 47.

I claim:

1. In door lock structure including a frame, the combination comprising:

(a) a latch bolt carried by the frame for movement between retracted and advanced positions relative to a jamb, the bolt in retracted position allowing door opening when the door is in a closed position, and in advanced position blocking door opening, (b) a first spring carried by the frame for urging the bolt towards advanced position, (c) a lever pivotally carried by the bolt for pivoting between a first position in which the lever blocks bolt retraction, and a second position in which the bolt is free for retraction, (d) the lever having a first part, and there being a second spring carried by the bolt and acting on said first part for yieldably urging the lever toward said first position, (e) the lever having a second part, and, there being an actuator carried by the frame and acting on said second part for pivoting the lever into said second position allowing movement of the bolt toward said retracted position, (f) and a counterweight on the lever for keeping the lever in said first position with the bolt in said advanced position, as in the event of deactivation of said first and second springs.

2. The combination of claim 1 including a blocking shoulder on said frame, and a dogging shoulder on the lever movable into position adjacent said blocking shoulder to block lever pivoting toward said second position in response to:

(i) bolt movement into said advanced position, and (ii) pivoting of the lever into said first position when the bolt is moved into said advanced position.

3. The combination of claim 2 wherein said lever has a first projection defining said first part, and a second projection defining said second part.

4. The combination of claim 2 including a slot on the frame for reception and travel of said dogging shoulder therealong, the blocking shoulder located adjacent the slot at one end of dogging shoulder travel therealong.

5. The combination of claim 4 wherein the slot extends in the direction of bolt movement between advanced and retracted positions, and the slot having an offset adjacent said locking shoulder, and into which the dogging shoulder is pivotable in response to lever urging by the second spring.

6. The combination of claim 5 wherein the counterweight tends to keep the dogging shoulder in said offset when the springs are melted.

7. The combination of claim 1 including an actuator carried by the frame for movement with said latch bolt between retracted and advanced positions, relative to the jamb, the auxiliary bolt having a projection for engagement with the jamb to displace the actuator relative to the frame, there being a part on the actuator that projects and engages the lever to block lever pivoting until the actuator is displaced, as aforesaid.

8. The combination of claim 4 wherein said frame includes spaced frame plates forming said slot, the slot having parallel sections defined by the two plates, and the lever located between said plates, and the dogging shoulder comprising two ears respectively slidable in and along said slot sections.

9. The combination of claim 1 including flange means on the bolt to block access to the lever via plate means defined by the frame, the plate means defining a bolt-receiving opening.

10. In a door retention assembly that locks a door in closed position in response to high temperature as during a fire, the door element having an edge portion closable into adjacent relation to an edge portion defined by a jamb element, there being a strike carried by one of the elements, the combination comprising:

(a) a latch carried by the other element to relatively move into latching relation with the strike when the door element is closed relative to the header element, thereby to hold the door closed, (b) and control means to control movement of the latch into and out of said latching relation with the strike, said control means including a mechanism carried by the latch for movement of said mechanism between a first position in which said mechanism blocks the latch against movement out of said latching relation with the strike, and a second position in which said latch movement is unblocked, and a counterweight and a heat-fusible spring, both normally urging said mechanism into said first position when the latch is in latching relation with the strike.

11. The combination of claim 10 wherein said mechanism comprises a lever pivotally carried by the latch.

12. The combination of claim 10 wherein said control means includes a rotor engageable with said mechanism and rotatable in one rotary direction to cause said mechanism to move the latch out of latching relation with the strike.

* * * * *